US010280915B2

(12) United States Patent
Kondo et al.

(10) Patent No.: US 10,280,915 B2
(45) Date of Patent: May 7, 2019

(54) FLUID CONTROL DEVICE

(71) Applicant: Murata Manufacturing Co., Ltd., Kyoto (JP)

(72) Inventors: Daisuke Kondo, Kyoto (JP); Kiyoshi Kurihara, Kyoto (JP); Hiroyuki Yokoi, Kyoto (JP); Hiroaki Wada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 129 days.

(21) Appl. No.: 15/403,619

(22) Filed: Jan. 11, 2017

(65) Prior Publication Data

US 2017/0138357 A1 May 18, 2017

Related U.S. Application Data

(63) Continuation of application No. PCT/JP2015/069392, filed on Jul. 6, 2015.

(30) Foreign Application Priority Data

Jul. 16, 2014 (JP) ..... 2014-145512

(51) Int. Cl.
*F04B 43/04* (2006.01)
*F04B 45/047* (2006.01)
(Continued)

(52) U.S. Cl.
CPC ..... *F04B 43/046* (2013.01); *F04B 43/04* (2013.01); *F04B 45/047* (2013.01); *F04B 49/06* (2013.01); *F04B 53/10* (2013.01)

(58) Field of Classification Search
CPC .... F04B 43/043; F04B 43/046; F04B 19/006; F04B 45/04; A61B 5/0235; A61B 5/02141
See application file for complete search history.

(56) References Cited

U.S. PATENT DOCUMENTS

2009/0232682 A1 9/2009 Hirata
2011/0070110 A1 3/2011 Hirata
(Continued)

FOREIGN PATENT DOCUMENTS

DE 102008004147 A1 7/2009
JP 2012-528981 A 11/2012
(Continued)

OTHER PUBLICATIONS

International Search Report issued in Application No. PCT/JP2015/069392 dated Aug. 18, 2015.
(Continued)

*Primary Examiner* — Kenneth J Hansen
(74) *Attorney, Agent, or Firm* — Pearne & Gordon LLP

(57) ABSTRACT

A fluid control device (10) having a flow passage passing through a pump chamber (45) and a valve chamber (40) includes a vibration unit (37) that vibrates to cause fluctuation of an internal pressure in the pump chamber (45), a valve bottom plate (23) facing the valve chamber (40) and having a communication hole (43) communicating with the pump chamber (45) at one end and communicating with the valve chamber (40) at the other end, and a valve top plate (21) facing the valve chamber (40) to be opposed to the valve bottom plate (23) and having a discharge hole (41) communicating with the valve chamber (40). The communication hole (43) and the discharge hole (41) are not opposed to each other, and the valve bottom plate (23) is elastically deformed by transmission of vibration of the vibration unit (37) thereto.

16 Claims, 14 Drawing Sheets

(51) Int. Cl.
*F04B 49/06* (2006.01)
*F04B 53/10* (2006.01)

(56) References Cited

U.S. PATENT DOCUMENTS

| | | | | |
|---|---|---|---|---|
| 2011/0076170 | A1* | 3/2011 | Fujisaki | F04B 45/047 417/415 |
| 2015/0150470 | A1* | 6/2015 | Sano | F04B 43/046 600/498 |

FOREIGN PATENT DOCUMENTS

| | | | | |
|---|---|---|---|---|
| JP | 5287854 | B2 | 9/2013 | |
| JP | 2013-245649 | A | 12/2013 | |
| WO | 2008/069266 | A1 | 6/2008 | |
| WO | WO 2013179789 | A1 * | 12/2013 | F04B 43/046 |

OTHER PUBLICATIONS

Written Opinion issued in Application No. PCT/JP2015/069392 dated Aug. 18, 2015.

* cited by examiner

FLUID CONTROL DEVICE

This is a continuation of International Application No. PCT/JP2015/069392 filed on Jul. 6, 2015 which claims priority from Japanese Patent Application No. 2014-145512 filed on Jul. 16, 2014. The contents of these applications are incorporated herein by reference in their entireties.

BACKGROUND OF THE DISCLOSURE

Field of the Disclosure

The present disclosure relates to a fluid control device including a pump that causes the pressure fluctuation in a fluid and a valve that directs the flow.

Description of the Related Art

There have hitherto been used various types of fluid control devices in which the pressure fluctuation of a fluid is caused in a pump chamber. In a certain type of fluid control devices, a pump chamber always communicates with the outside without providing a valve structure in a flow passage connected to the pump chamber, and the flow of the fluid in one direction is produced in the flow passage by setting, for example, the shape of the flow passage (see, for example, Patent Document 1). In such a fluid control device in which the pump chamber always communicates with the outside, a high pressure amplitude (for example, several tens of kilopascals) generated in the pump chamber cannot serve as the fluid pressure of the fluid as it is, and it is difficult to achieve a high fluid pressure.

For this reason, a fluid control device that can achieve a high fluid pressure by providing a check valve structure (valve) in a flow passage has been sometimes used (see, for example, Patent Document 2). In the fluid control device disclosed in Patent Document 2, a valve chamber is provided in a flow passage on a discharge side of a pump chamber, and a displaceable film is provided inside the valve chamber. When fluid is going to flow back toward the pump chamber, the flow passage is closed by the film displaceable in accordance with the flow of the fluid to prevent the backflow of the fluid. This obtains a high fluid pressure close to a high pressure amplitude generated inside the pump chamber.

Patent Document 1: Japanese Patent No. 5287854

Patent Document 2: Japanese Unexamined Patent Application Publication (Translation of PCT Application) No. 2012-528981

BRIEF SUMMARY OF THE DISCLOSURE

In the structure including the valve as in Patent Document 2 described above, when the frequency at which the pressure fluctuation occurs in the pump chamber (driving frequency of the pump) is high, the responsiveness of the check valve structure to the fluctuation of the fluid pressure sometimes becomes a problem. Specifically, in order for the film provided in the valve chamber to function as the valve, the motion of the film needs to follow the fluctuation of the fluid pressure, and the film needs to be displaceable on a time scale greatly shorter than the time scale on which the fluid pressure fluctuates.

To improve the followability of the film with respect to the fluctuation of the fluid pressure, it is effective to reduce the weight of the film. However, there have been few materials for the film which are lighter than popular resin such as PET. Further, even when the weight is reduced by thinning the film, breakage, such as a tear, is likely to occur in the film. Hence, it is difficult to improve the followability of the film by thinning the film.

For this reason, in the structure of Patent Document 2, the distance between plates that define the valve chamber is made extremely short to respond to a high driving frequency. When the distance between the plates that define the valve chamber is short, the moving distance of the film inside the valve chamber is short, and this can shorten the time necessary for the movement of the film. Thus, even when the followability of the film with respect to the fluctuation of the fluid pressure is not so high, the responsiveness of the valve to the fluctuation of the fluid pressure can be improved. The film can function as the check valve even when the driving frequency is high. In this case, however, when the distance between the plates that define the valve chamber is short, the flow passage resistance inside the valve chamber is sometimes brought into an unignorable range, and this makes it difficult to achieve a high flow rate.

Accordingly, an object of the present disclosure is to provide a fluid control device that can achieve a high flow rate while improving the responsiveness of a valve.

The present disclosure provides a fluid control device having a flow passage passing through a pump chamber and a valve chamber. The fluid control device includes a vibration unit that vibrates to cause the fluctuation of an internal pressure in the pump chamber, a first plate facing the valve chamber and having a first flow passage hole communicating with the pump chamber at one end and communicating with the valve chamber at the other end, and a second plate facing the valve chamber to be opposed to the first plate and having a second flow passage hole communicating with the valve chamber. The first flow passage hole and the second flow passage hole are not opposed to each other, and at least one of the first plate and the second plate is elastically deformed in a direction in which the first plate and the second plate are opposed by transmission of vibration of the vibration unit thereto.

In this structure, the vibration of the vibration unit is transmitted to at least one of the first plate and the second plate, and the minimum distance between the first plate and the second plate (hereinafter referred to as a plate distance) is thereby changed. Then, in a state in which the plate distance decreases, the flow passage resistance in the valve chamber increases. In a state in which the plate distance increases, the flow passage resistance in the valve chamber decreases. For this reason, the increase or decrease in the flow passage resistance occurs in the valve chamber in synchronization with the pressure fluctuation in the pump chamber, and this can achieve a highly responsive valve. Since the flow passage resistance in the valve chamber decreases in the state in which the plate distance increases, a high flow rate can be ensured.

Preferably, the fluid control device further includes a film disposed between the first plate and the second plate, and the film has a third flow passage hole disposed not to be opposed to the first flow passage hole and to be opposed to the second flow passage hole.

In this structure, displacement or deformation occurs in the film owing to the transmission of the fluctuation of the fluid pressure to the film. Then, when the fluid pressure increases in the pump chamber, the film approaches the second plate. Since the second flow passage hole of the second plate is opposed to the third flow passage hole of the film, even when the film approaches the second plate, the second flow passage hole is opened. When the fluid pressure decreases in the pump chamber, the film approaches the first plate. Since the first flow passage hole of the first plate is not opposed to the third flow passage hole of the film, when the film approaches the first plate, the first flow passage hole is closed. Then, when the second flow passage hole is opened and the plate distance is increased, the flow passage resistance in the valve chamber decreases, and the flow rate increases. In contrast, when the first flow passage hole is closed and the plate distance is decreased, the moving distance and the moving time of the film are reduced, and this improves the responsiveness to the fluctuation of the fluid pressure.

At least one of the first plate and the second plate may vibrate in a manner coupled to the vibration of the vibration unit. Alternatively, at least one of the first plate and the second plate may be vibrated by the transmission of the vibration of the vibration unit thereto via fluid.

In particular, the at least one of the first plate and the second plate preferably has a structure resonant frequency that coincides with a vibration frequency of the vibration unit. Both the first plate and the second plate are preferably vibrated by the transmission of the vibration of the vibration unit thereto.

Since the plate distance greatly changes in any case, a higher responsiveness and a higher flow rate can be achieved.

A phase of the fluctuation of a distance between the first plate and the second plate preferably has a phase difference from a phase of the vibration of the vibration unit. In particular, the phase of the fluctuation of the distance between the first plate and the second plate preferably coincides with a phase of the fluctuation of a flow rate through the first flow passage hole, or is preferably closer to the phase of the vibration of the vibration unit than the phase of the fluctuation of the flow rate through the first flow passage hole.

According to this structure, a higher flow rate can be achieved.

The vibration unit may include a diaphragm facing the pump chamber and a piezoelectric element fixed to the diaphragm.

According to the present disclosure, since the flow passage resistance in the valve chamber is changed by changing the plate distance through the transmission of the vibration of the vibration unit, a high flow rate can be ensured while achieving high responsiveness of the valve to the fluctuation of the fluid pressure.

DETAILED DESCRIPTION OF THE DISCLOSURE

First Embodiment

A fluid control device 11 according to a first embodiment of the present disclosure will be described below with reference to FIGS. 1 to 9.

Figure 1:
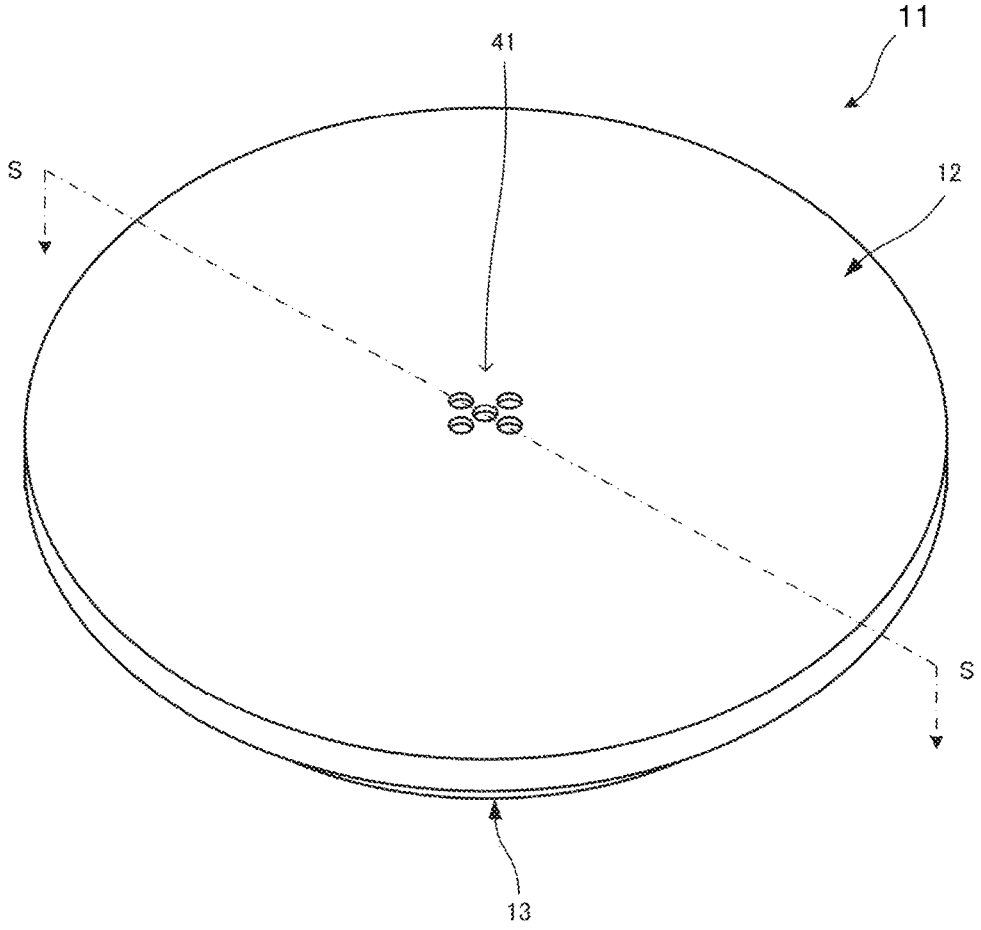
FIG. 1 is an external perspective view of a fluid control device according to a first embodiment of the present disclosure, when viewed from a top surface side.
Figure 2:
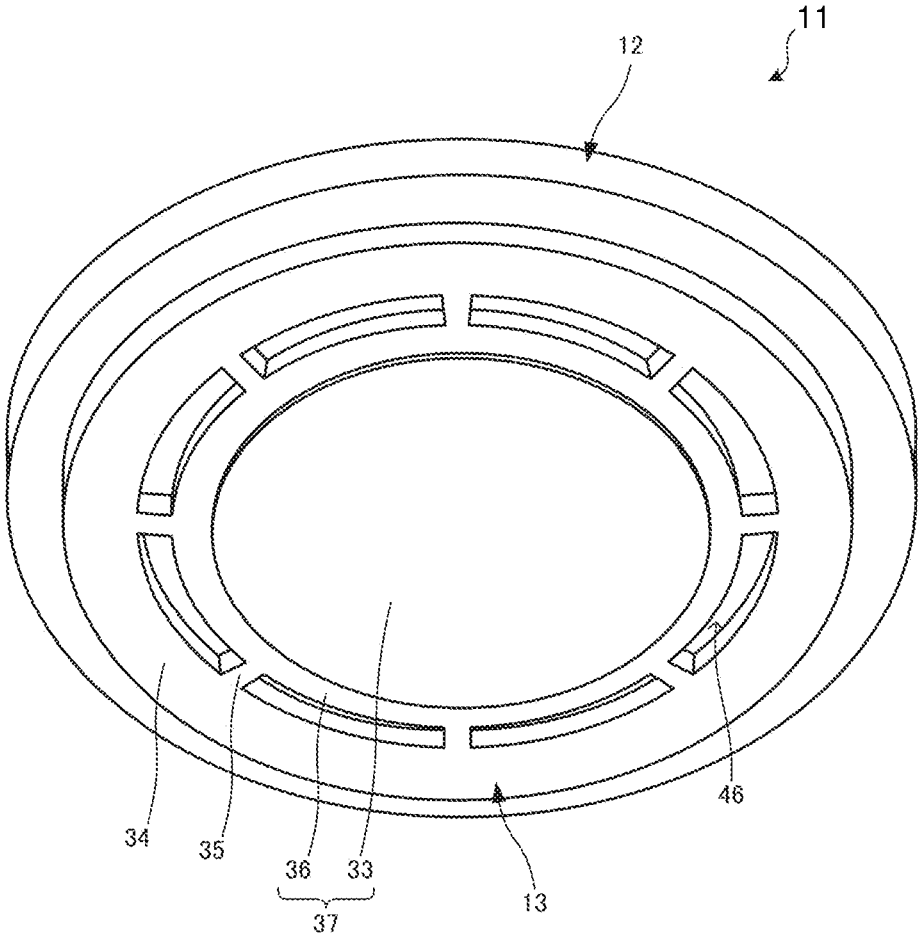
FIG. 2 is an external perspective view of the fluid control device illustrated in FIG. 1, when viewed from a bottom surface side.
Figure 3:
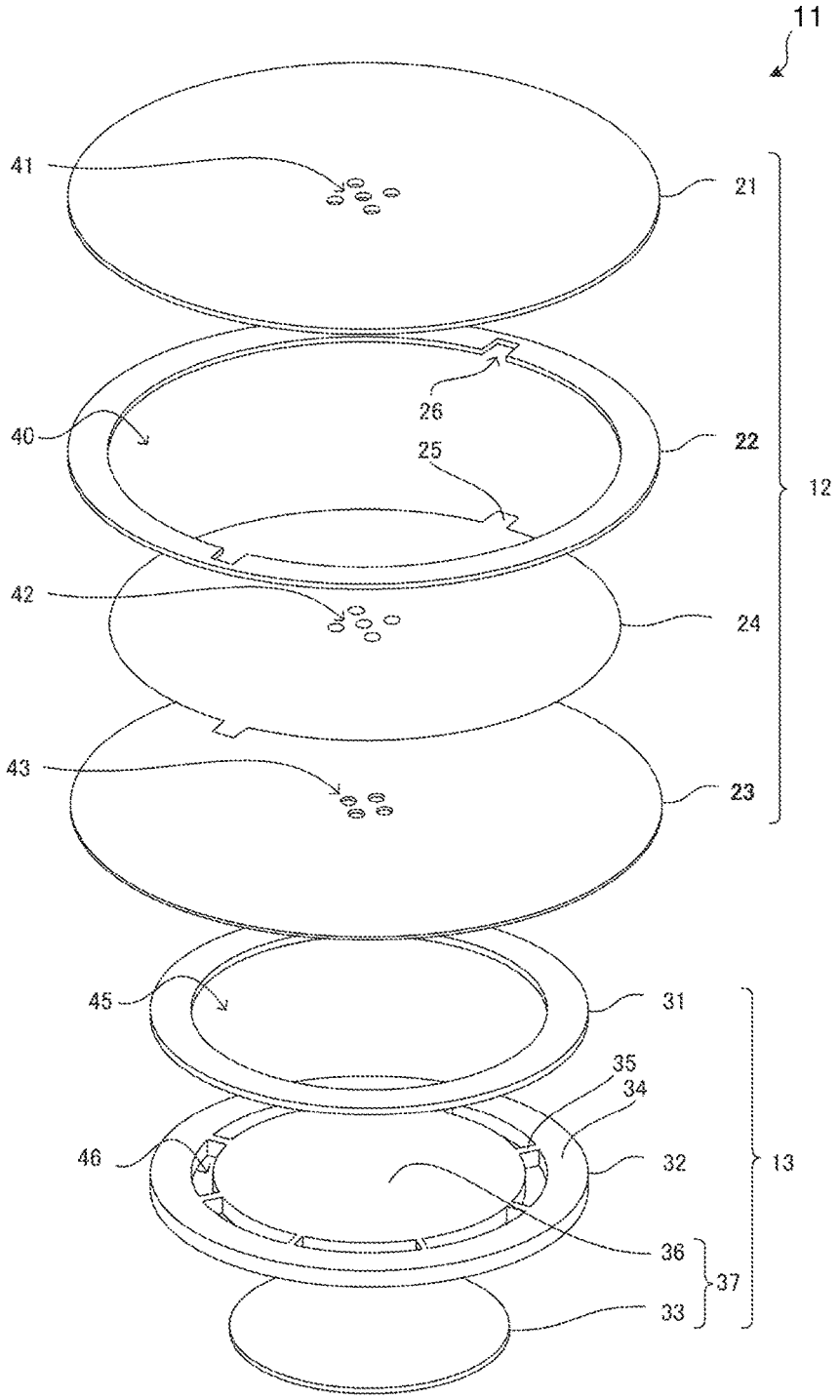
FIG. 3 is an exploded perspective view of the fluid control device illustrated in FIG. 1.
Figure 4:
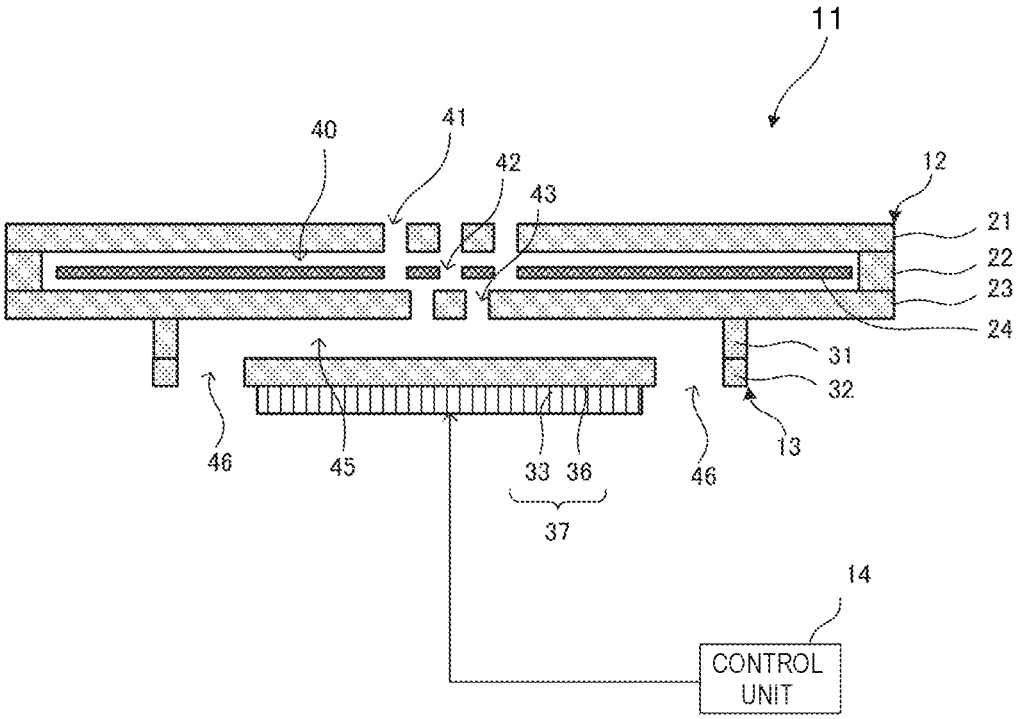
FIG. 4 is a sectional side view of the fluid control device illustrated in FIG. 1.

FIG. 1 is an external perspective view of the fluid control device 11 when viewed from a top surface side. FIG. 2 is an external perspective view of the fluid control device 11 when viewed from a bottom surface side. FIG. 3 is an exploded perspective view of the fluid control device 11. FIG. 4 is a sectional side view of the fluid control device 11.

The fluid control device 11 includes a valve unit 12, a pump unit 13, and a control unit 14 (see FIG. 4). The valve unit 12 is disposed on the top surface side of the fluid control device (see FIG. 1). The pump unit 13 is disposed on the bottom surface side of the fluid control device 11 (see FIG. 2). The valve unit 12 and the pump unit 13 are bonded to each other in a lamination state.

The valve unit 12 has the function of directing the flow of fluid. The valve unit 12 is shaped like a cylindrical container in which a valve chamber 40 is provided, and includes a valve top plate 21, a valve side wall plate 22, a valve bottom plate 23, and a film 24 (see FIGS. 3 and 4). The valve bottom plate 23 corresponds to the first plate of the present disclosure. The valve top plate 21 corresponds to the second plate of the present disclosure.

The valve top plate 21 is disposed on the top surface side of the valve unit 12. The valve side wall plate 22 is disposed between the valve top plate 21 and the valve bottom plate 23. The valve bottom plate 23 is disposed on the bottom surface side of the valve unit 12. The valve top plate 21, the valve side wall plate 22, and the valve bottom plate 23 are bonded together in a lamination state. The film 24 is stored inside the valve unit 12, that is, in the valve chamber 40.

The valve top plate 21 is disc-shaped when viewed from the top surface side. The valve side wall plate 22 is annular when viewed from the top surface side. The valve bottom plate 23 is disc-shaped when viewed from the top surface side. The valve top plate 21, the valve side wall plate 22, and the valve bottom plate 23 are equal in outside diameter.

The valve chamber 40 is provided with a predetermined aperture diameter near the center of the principal surface of the valve side wall plate 22 when viewed from the top surface side. The film 24 is substantially disc-shaped when viewed from the top surface side, and its thickness is set to be smaller than that of the valve side wall plate 22. The outside diameter of the film 24 is substantially equal to the aperture diameter of the valve chamber 40 in the valve side wall plate 22, but is set to be slightly smaller than the aperture diameter to form a small gap therebetween. Projections 25 are provided in portions of the outer periphery of the film 24 (see FIG. 3). Cutouts 26 are provided in portions of the inner periphery of the valve side wall plate 22 so that the projections 25 are fitted therein with a small gap therebetween (see FIG. 3). For this reason, the film 24 is held inside the valve chamber 40 so that it cannot rotate but can move up and down.

Near the center of the principal surface of the valve top plate 21 when viewed from the top surface side, a plurality of discharge holes 41 are provided in a predetermined arrangement. The discharge holes 41 correspond to the second flow passage hole of the present disclosure. Near the center of the principal surface of the valve bottom plate 23 when viewed from the top surface side, a plurality of communication holes 43 are provided in a predetermined arrangement. The communication holes 43 correspond to the first flow passage hole of the present disclosure. Therefore, the valve chamber 40 communicates with the outside through the discharge holes 41 and communicates with the pump unit 13 through the communication holes 43.

Near the center of the principal surface of the film 24 when viewed from the top surface side, a plurality of film holes 42 are provided in a predetermined arrangement. The film holes 42 correspond to the third flow passage hole of the present disclosure. The film holes 42 and the discharge holes 41 are arranged opposed to each other. On the other hand, the film holes 42 and the communication holes 43 are arranged not to be opposed to each other.

The pump unit 13 has the function of causing pressure fluctuation in a fluid. The pump unit 13 is shaped like a cylindrical container in which a pump chamber 45 is provided, and includes a pump side wall plate 31, a pump bottom plate 32, and a piezoelectric element 33. The pump side wall plate 31 is disposed between the valve bottom plate 23 and the pump bottom plate 32. The pump bottom plate 32 is disposed between the pump side wall plate 31 and the piezoelectric element 33. The piezoelectric element 33 is disposed on the bottom surface side of the pump unit 13. The pump side wall plate 31 is bonded to a bottom surface of the valve bottom plate 23 in a lamination state. The pump side wall plate 31, the pump bottom plate 32, and the piezoelectric element 33 are bonded together in a lamination state.

The pump side wall plate 31 is annular when viewed from the top surface side. The pump chamber 45 is provided with a predetermined aperture diameter near the center of the principal surface of the pump side wall plate 31 when viewed from the top surface side. The pump bottom plate 32 has an outer peripheral portion 34. The outer peripheral portion 34 is annular when viewed from the top surface side, and has an aperture with a predetermined aperture diameter near the center of the principal surface thereof when viewed from the top surface side. The pump side wall plate 31 and the outer peripheral portion 34 of the pump bottom plate 32 are equal in outside diameter and aperture diameter, and are bonded to each other in a lamination state. The outside diameter of the pump side wall plate 31 and the pump bottom plate 32 is set to be smaller by a fixed dimension than the outside diameter of the valve unit 12.

The pump bottom plate 32 includes a plurality of beam portions 35 and a diaphragm 36 in addition to the outer peripheral portion 34. The diaphragm 36 is disc-shaped when viewed from the top surface side, and is disposed inside the aperture of the outer peripheral portion 34 with a gap interposed between the diaphragm 36 and the outer peripheral portion 34. The plural beam portions 35 are provided in the gap between the outer peripheral portion 34 and the diaphragm 36, and extend along the circumference of the pump bottom plate 32 to connect the diaphragm 36 and the outer peripheral portion 34. Therefore, the diaphragm 36 is supported in midair by the beam portions 35, and can move up and down in the thickness direction. The gap between the outer peripheral portion 34 and the diaphragm 36 is provided as suction holes 46.

The piezoelectric element 33 is shaped like a disc having a radius smaller than that of the diaphragm 36, when viewed from the top surface side, and is bonded to a bottom surface of the diaphragm 36. The piezoelectric element 33 is formed of, for example, a PZT-based ceramic material. Both principal surfaces of the piezoelectric element 33 have unillustrated electrodes, and a driving voltage is applied thereto from the control unit 14 via the electrodes. The piezoelectric element 33 has piezoelectricity such as to expand and contract in the in-plane direction according to the applied driving voltage. Therefore, when the driving voltage is applied to the piezoelectric element 33, the piezoelectric element 33 attempts to expand and contract in the in-plane direction, and this causes concentric bending vibration in the diaphragm 36. By this bending vibration, vibration is also caused in the beam portions 35 that elastically support the diaphragm 36, so that the diaphragm 36 vibrates to be displaced up and down. In this way, the piezoelectric element 33 and the diaphragm 36 integrally vibrate, and constitute a vibration unit 37 of the present disclosure.

Here, the control unit 14 matches the driving frequency of the piezoelectric element 33 to the acoustic resonant frequency of the pump chamber 45. The acoustic resonant frequency of the pump chamber 45 refers to the frequency at which the pressure vibration generated in a center portion of the pump chamber 45 resonates with the pressure vibration obtained as a result that the above-described pressure vibration propagates toward the outer peripheral portion, is reflected, and reaches the center portion of the pump chamber 45 again. In this case, at least a part near the center portion in the planar direction serves as an antinode of bending vibration, and at least a part near the outer peripheral portion in the planar direction serves as a node of bending vibration. That is, in the pump chamber 45, a pressure distribution of a standing wave shape occurs in the planar direction. Thus, the pressure fluctuation of the fluid becomes large near the communication holes 43 opposed to the center portion of the pump chamber 45 in the planar direction, and there is little pressure fluctuation of the fluid near the suction holes 46 opposed to the outer peripheral portion of the pump chamber 45 in the planar direction. Therefore, when the suction holes 46 communicate with the outer peripheral portion of the pump chamber 45 in the planar direction, little pressure loss through the suction holes 46 occurs even when a valve or the like is not provided in the suction holes 46. Therefore, the shape and size of the suction holes 46 can be arbitrarily determined. For example, this can obtain a high flow rate of fluid.

Figure 5A:
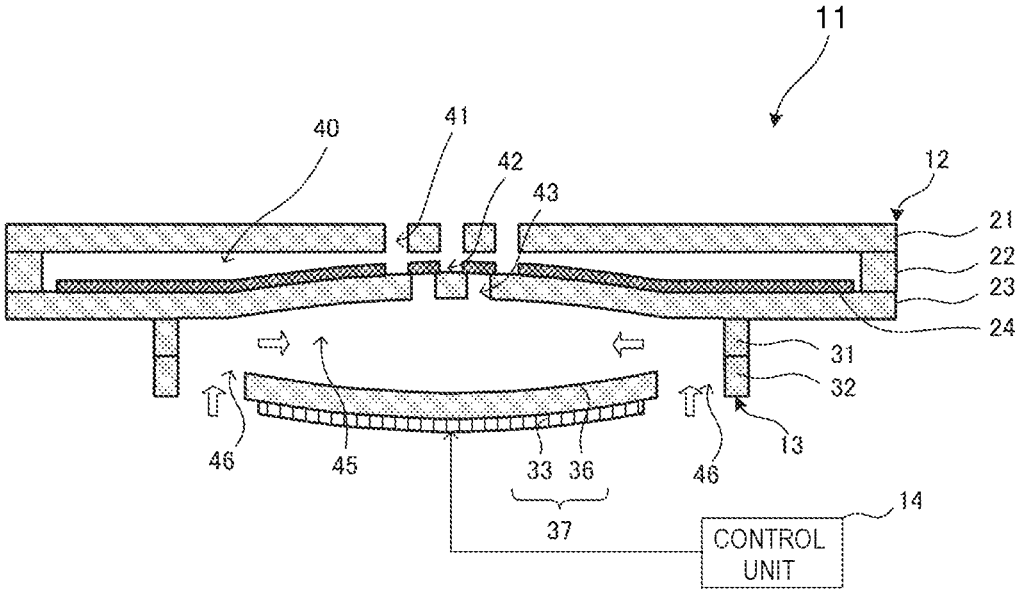
FIGS. 5A and 5B include sectional side views each illustrating a first vibration mode of the fluid control device illustrated in FIG. 1.
Figure 5B:
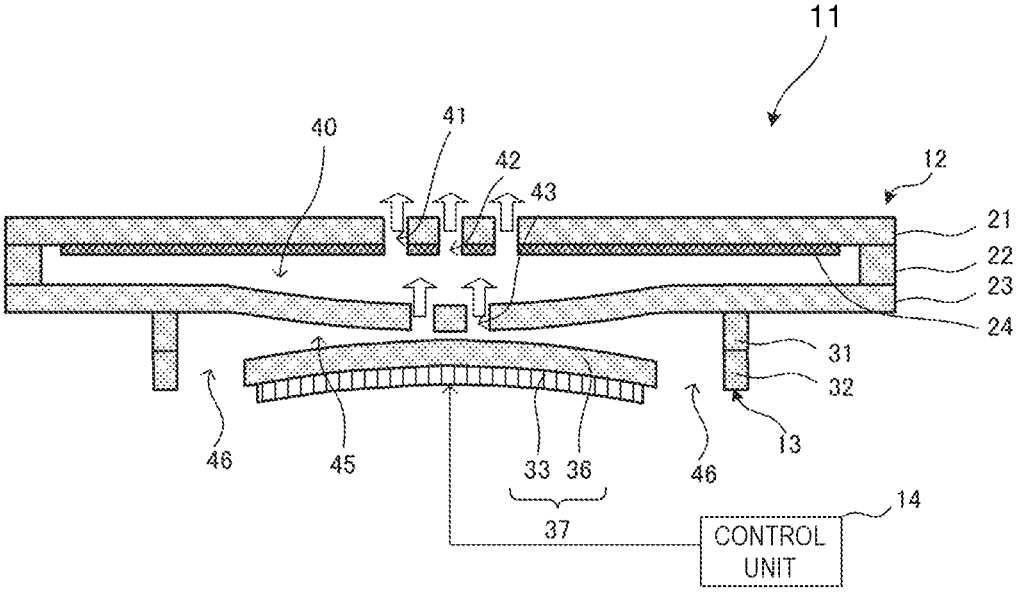

FIGS. 5A and 5B include sectional side views each schematically illustrating a first vibration mode of the fluid control device 11. Here, a case in which the vibration of the vibration unit 37 directly propagates through the structural members of the pump unit 13 to cause the vibration in the valve unit 12 will be described as an example.

When the piezoelectric element 33 attempts to expand upon the application of the driving voltage, as illustrated in FIG. 5A, expansion of the piezoelectric element 33 bends the diaphragm 36 to be convex to the bottom surface side in the thickness direction. This increases the capacity of the pump chamber 45, and reduces the internal pressure of the pump chamber 45. Then, the internal pressure of a space closer to the bottom surface side than the film 24 becomes lower than the internal pressure of a space closer to the top surface side than the film 24. Thus, the film 24 is attracted toward the bottom surface side in the valve chamber 40, and is brought into close contact with a top surface of the valve bottom plate 23. At this time, since the film holes 42 of the film 24 are not opposed to the communication holes 43 of the valve bottom plate 23, the film 24 closes the communication holes 43. Thus, in the situation in which the internal pressure of the pump chamber 45 is reduced, the flow of the fluid through the valve chamber 40 is hindered, and the external fluid is sucked into the pump chamber 45 through the suction holes 46.

In contrast, when the piezoelectric element 33 attempts to contract in the in-plane direction, as illustrated in FIG. 5B, contraction of the piezoelectric element 33 bends the diaphragm 36 to be convex to the top surface side in the thickness direction. This decreases the capacity of the pump chamber 45, and increases the internal pressure of the pump chamber 45. Then, in the valve chamber 40, the internal pressure of the space closer to the bottom surface side than the film 24 becomes higher than the internal pressure of the space closer to the top surface side than the film 24. Thus, the film 24 is pushed away toward the top surface side in the valve chamber 40, and is brought into close contact with the bottom surface of the valve top plate 21. At this time, since the film holes 42 of the film 24 are opposed to the discharge holes 41 of the valve top plate 21, the discharge holes 41 are opened even when the film 24 is in close contact with the bottom surface of the valve top plate 21. Thus, in the situation in which the internal pressure of the pump chamber 45 increases, the flow of fluid through the valve chamber 40 is not hindered, and the fluid is discharged outside from the pump chamber 45 through the communication holes 43, the valve chamber 40, the film holes 42, and the discharge holes 41.

Then, vibration of the vibration unit 37 directly propagates through the pump unit 13, and causes vibration in the valve bottom plate 23. The valve bottom plate 23 is thereby elastically deformed to move up and down in the thickness direction. As illustrated in FIG. 5A, when the vibration unit 37 bends toward the bottom surface side to suck the external fluid from the suction holes 46, the valve bottom plate 23 bends toward the top surface side contrary to the vibration unit 37. Thus, the capacity of the pump chamber 45 increases, and the plate distance between the valve top plate 21 and the valve bottom plate 23 in the valve chamber 40 decreases. Therefore, the moving distance and moving time when the film 24 is attracted toward the bottom surface side in the valve chamber 40 are reduced. This allows the film 24 to follow the fluctuation of the fluid pressure, and increases the responsiveness of the valve unit 12.

In contrast, as illustrated in FIG. 5B, when the vibration unit 37 bends toward the top surface side, the valve bottom plate 23 bends toward the bottom surface side contrary to the vibration unit 37. This further decreases the capacity of the pump chamber 45, and increases the plate distance in the valve chamber 40. Therefore, even when the plate distance during the settling time is set short to some extent in the valve chamber 40, it increases during driving and this reduces the flow passage resistance. Consequently, the fluid control device 11 can ensure a high discharge flow rate.

Figure 6A:
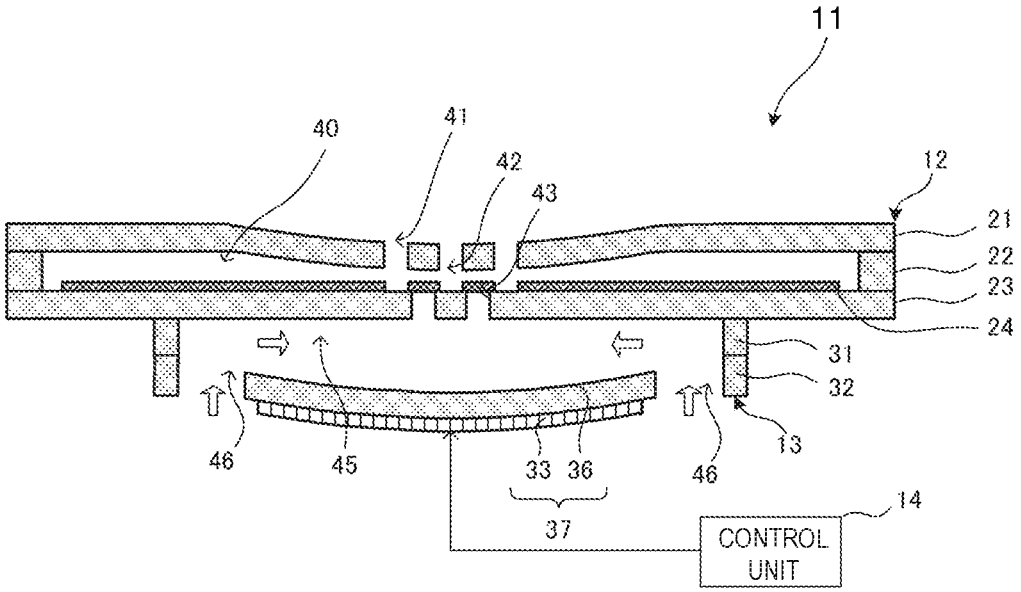
FIGS. 6A and 6B include sectional side views each illustrating a second vibration mode of the fluid control device illustrated in FIG. 1.
Figure 6B:
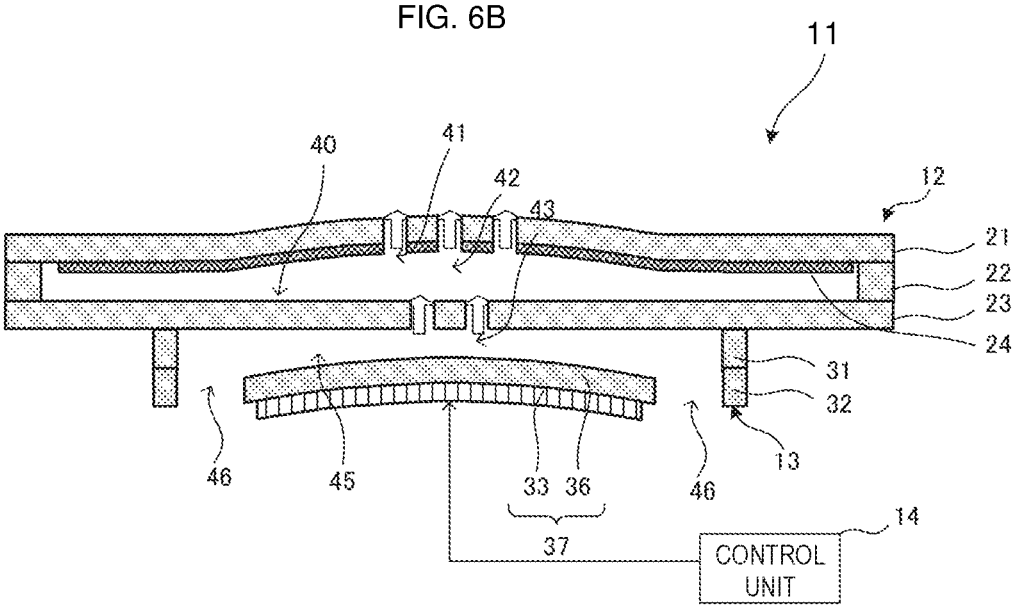

FIGS. 6A and 6B include sectional side views each schematically illustrating a second vibration mode of the fluid control device 11. Here, a case in which the vibration of the pump unit 13 is transmitted through the fluid to cause vibration in the valve unit 12 will be described as an example.

As illustrated in FIG. 6A, when the diaphragm 36 bends toward the bottom surface side, the internal pressure of the pump chamber 45 decreases, and the film 24 is attracted toward the bottom surface side in the valve chamber 40 and hinders the flow of fluid. External fluid is sucked into the pump chamber 45 through the suction holes 46. As illustrated in FIG. 6B, when the diaphragm 36 bends toward the top surface side, the internal pressure of the pump chamber 45 increases, and the film 24 is pushed away toward the top surface side in the valve chamber 40, but does not hinder the flow of fluid. The fluid is discharged outside from the pump unit 13 through the valve unit 12.

Then, the vibration of the vibration unit 37 causes the vibration in the valve top plate 21 through the pressure fluctuation of the fluid. In other words, the discharged air directed from the communication holes 43 toward the valve chamber 40 is caused by the fluctuation of the fluid pressure in the pump chamber 45 resulting from the vibration of the vibration unit 37, and this discharged air causes the vibration in the valve top plate 21. Thus, the valve top plate 21 also elastically deforms to move up and down in the thickness direction. As illustrated in FIG. 6B, when the vibration unit 37 bends toward the top surface side to discharge the fluid from the pump chamber 45 to the valve chamber 40 through the communication holes 43, the valve top plate 21 bends toward the top surface side similarly to the vibration unit 37. This increases the plate distance in the valve chamber 40. Therefore, even when the plate distance during the settling time is short to some extent in the valve chamber 40, the flow passage resistance is reduced by the increase in the plate distance during driving. Consequently, the fluid control device 11 can ensure a high discharge flow rate.

In contrast, when the vibration unit 37 bends toward the bottom surface side, as illustrated in FIG. 6A, the valve top plate 21 is bent toward the bottom surface side by counteraction from the state of FIG. 6B. This decreases the plate distance in the valve chamber 40. Therefore, the moving distance and moving time are reduced when the film 24 is attracted toward the bottom surface side in the valve chamber 40. This allows the film 24 to follow the fluctuation of the fluid pressure, and improves the responsiveness of the valve unit 12.

As described above, vibration is caused in the valve unit 12 by direct propagation of the vibration of the vibration unit 37 in the pump unit 13 or the indirect transmission of the vibration via the fluid. While any one of the vibration of the valve bottom plate 23 illustrated in FIGS. 5A and 5B and the vibration of the valve top plate 21 illustrated in FIGS. 6A and 6B sometimes mainly occurs in the vibration mode, the vibration of the valve bottom plate 23 and the vibration of the valve top plate 21 are sometimes superimposed in the vibration mode. Alternatively, the vibration caused in one of the valve bottom plate 23 and the valve top plate 21 as described above sometimes directly propagates in the valve unit 12 and is transmitted to the other of the valve bottom plate 23 and the valve top plate 21 to cause the vibration.

In any of the vibration modes, when the fluid is discharged from the pump chamber 45 to the valve chamber 40 through the communication holes 43, the plate distance in the valve chamber 40 is increased. This allows the fluid control device 11 to ensure a high flow rate. Further, when external fluid is sucked into the pump chamber 45 through the suction holes 46, the plate distance in the valve chamber 40 is decreased, and this improves responsiveness of the valve unit 12.

Next, a description will be given of a specific setting method for the fluid control device 11. The discharge flow rate of the fluid control device 11 is influenced by the amplitude and phase of the plate distance and the amplitude and phase of the flow rate of fluid flowing through the communication holes 43. For this reason, the discharge flow rate can be increased by properly setting these factors. The phase to be described below refers to the phase difference based on the driving voltage of the vibration unit 37 unless otherwise stated.

The amplitude of the plate distance changes on the basis of the relationship between the structure resonant frequency (natural frequency) of the valve top plate 21 and the valve bottom plate 23 and the driving frequency of the vibration unit 37. Specifically, the amplitude of the plate distance can be increased by making the structure resonant frequency (natural frequency) of the valve top plate 21 and the valve bottom plate 23 closer to the driving frequency of the vibration unit 37. The phase of the plate distance changes on the basis of the magnitude relationship between the driving frequency of the vibration unit 37 and the structure resonant frequency (natural frequency) of the valve top plate 21 and the valve bottom plate 23. Specifically, when the structure resonant frequency (natural frequency) of the valve top plate 21 and the valve bottom plate 23 is sufficiently higher than the driving frequency of the vibration unit 37, the phase of the plate distance is the same as the phase of the driving frequency of the vibration unit 37. In contrast, when the structure resonant frequency (natural frequency) of the valve top plate 21 and the valve bottom plate 23 is sufficiently lower than the driving frequency of the vibration unit 37, the phase of the plate distance is opposite from the phase of the driving frequency of the vibration unit 37. The phase of the plate distance can be finely set by adjusting and setting the structure resonant frequency (natural frequency) of the valve top plate 21 and the valve bottom plate 23 near the driving frequency of the vibration unit 37.

Figure 7A:
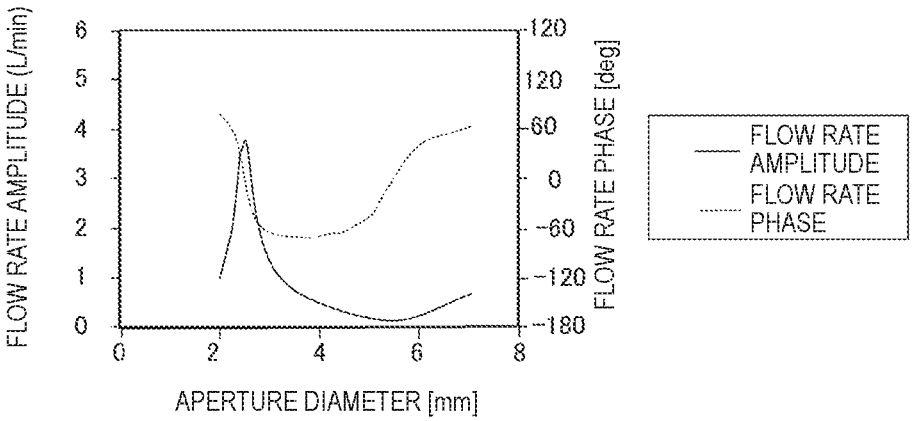
FIGS. 7A and 7B include graphs each showing the relationship between the vibration phase and discharging performance in the fluid control device illustrated in FIG. 1.

The flow rate amplitude and the flow rate phase at the communication holes 43 are controlled by acoustic resonance of the fluid. For example, the flow rate amplitude and the flow rate phase at the communication holes 43 are changed by the influence of the aperture diameter of the pump chamber 45. FIG. 7A shows the influence of the aperture diameter of the pump chamber 45 on the flow rate amplitude and the flow rate phase at the communication holes 43. As shown in FIG. 7A, the flow rate amplitude and the flow rate phase at the communication holes 43 can be controlled and set by controlling design parameters relating to acoustic resonance of the fluid.

The amplitude and the phase of the plate distance and the flow rate amplitude and the flow rate phase at the communication holes 43 can be adjusted by using, as the design parameters, the aperture diameters of the valve chamber 40 and the pump chamber 45, the heights of the valve chamber 40 and the pump chamber 45, the resonant frequency of the entire fluid control device 11, the aperture diameters of the communication holes 43 and the discharge holes 41, the material characteristics, thickness, and the outside diameters of the components, and so on.

For example, the discharge flow rate can be increased by setting the phase difference between the phase of the plate distance and the flow rate phase at the communication holes 43 within the following range.

Figure 7B:
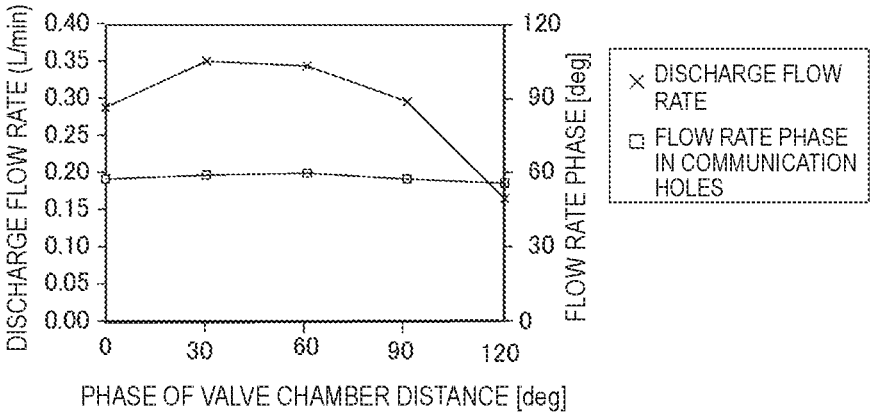

FIG. 7B shows the influence of the phase difference between the phase of the plate distance and the flow rate phase at the communication holes 43 on the discharge flow rate. In the fluid control device 11, the discharge flow rate can be changed by adjusting the phase of the plate distance and the flow rate phase at the communication holes 43. In an adjustment example shown in FIG. 7B, the flow rate phase is substantially fixed at about 60 degrees, and the phase of the plate distance is adjusted. In FIG. 7B, when the phase of the plate distance is set within the range of ±30 degrees centered on 60 degrees close to the flow rate phase at the communication holes 43, a more marked increase in discharge flow rate than within other ranges is found. In particular, the discharge flow rate is maximized in the range from 30 degrees where the phase of the plate distance is slightly advanced from the flow rate phase at the communication holes 43 to 60 degrees where the phase of the plate distance is substantially equal to the flow rate phase at the communication holes 43. This shows that the discharge flow rate can be increased by making the phase of the plate distance equal to the flow rate phase at the communication holes 43 or making the phase of the plate distance closer to the vibration phase of the driving unit (corresponding to the horizontal axis (0 degrees) in FIG. 7B) than the flow rate phase at the communication holes 43.

For example, the discharge flow rate can also be increased by setting the amplitude of the plate distance within the following range.

Figure 8A:
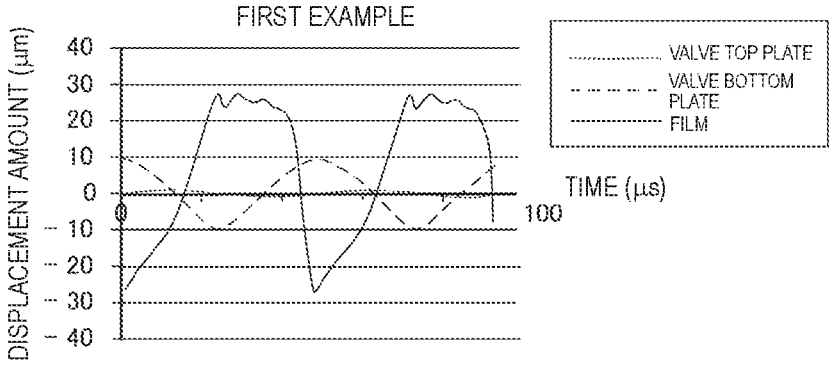
FIGS. 8A, 8B and 8C include graphs each showing the relationship between the vibration amplitude and the discharging performance in the fluid control device illustrated in FIG. 1.
Figure 8B:
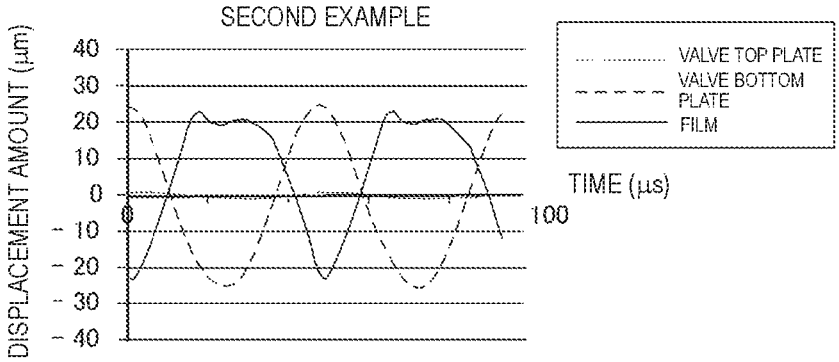

FIGS. 8A and 8B show temporal changes in displacement amount of the valve top plate 21, the valve bottom plate 23, and the film 24. FIG. 8A corresponds to a first example. FIG. 8B corresponds to a second example. In the first example, the maximum value of the displacement amount of the valve bottom plate 23 (vibration amplitude), that is, the fluctuation of the plate distance is relatively small, and the first example corresponds to a structure in which the structure resonant frequency of the valve bottom plate 23 is shifted from the driving frequency of the vibration unit 37. In contrast, in the second example, the fluctuation of the plate distance is relatively large, and the second example corresponds to a structure in which structural resonance is caused by making the structure resonant frequency of the valve bottom plate 23 equal to the driving frequency of the vibration unit 37.

In both the first example and the second example, vibration occurs in a period substantially equal to the driving period (driving frequency) of the vibration unit 37 in all of the valve top plate 21, the valve bottom plate 23, and the film 24 by driving the vibration unit 37. The vibration phases of the valve top plate 21 and the valve bottom plate 23 are delayed with respect to the vibration phase of the film (equivalent to the flow rate phase at the communication holes 43).

Figure 8C:
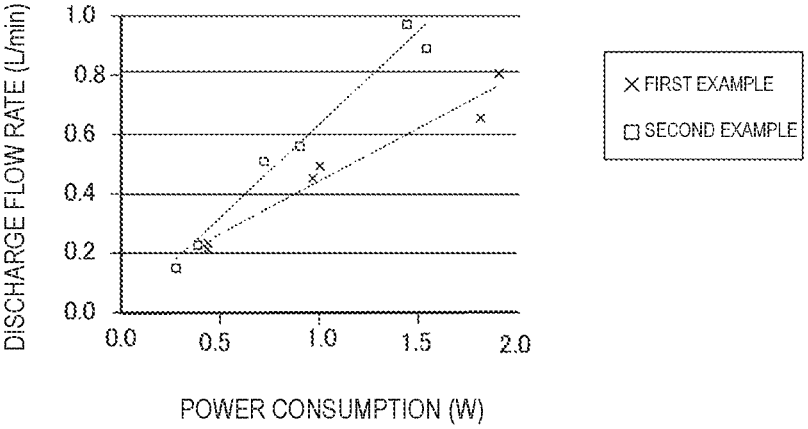

FIG. 8C shows the change in discharge flow rate when power consumption is made different between the first example and the second example by setting of the control unit 14. In both the first example and the second example, the increase in power consumption means that the vibration amplitude of the vibration unit 37 increases. This also means that the amplitude of the plate distance caused by vibration of the vibration unit 37 increases.

The graph shows that the obtained discharge flow rate increases as the power consumption increases in both the first example and the second example. Particularly when the amplitude of the plate distance is larger as in the second example, the increase rate of the discharge flow rate with respect to the increase in power consumption is higher than when the amplitude of the plate distance is smaller as in the first example, and it is confirmed that the absolute value of the discharge flow rate at the same power consumption becomes about 1.5 times larger. That is, in the first example and the second example, it is shown that the magnitude of the amplitude of the plate distance and the magnitude of the discharge flow rate of the fluid control device 11 are correlated with each other and that the discharge flow rate in the fluid control device 11 increases as the amplitude of the plate distance increases.

The discharge flow rate in the fluid control device 11 can be increased by performing appropriate setting and adjustment, as described above. The above-described adjustment method for the discharge flow rate is just an example. By adjusting other various design parameters, the amplitude and the phase of the plate distance can be adjusted to control the discharge flow rate.

Figure 9:
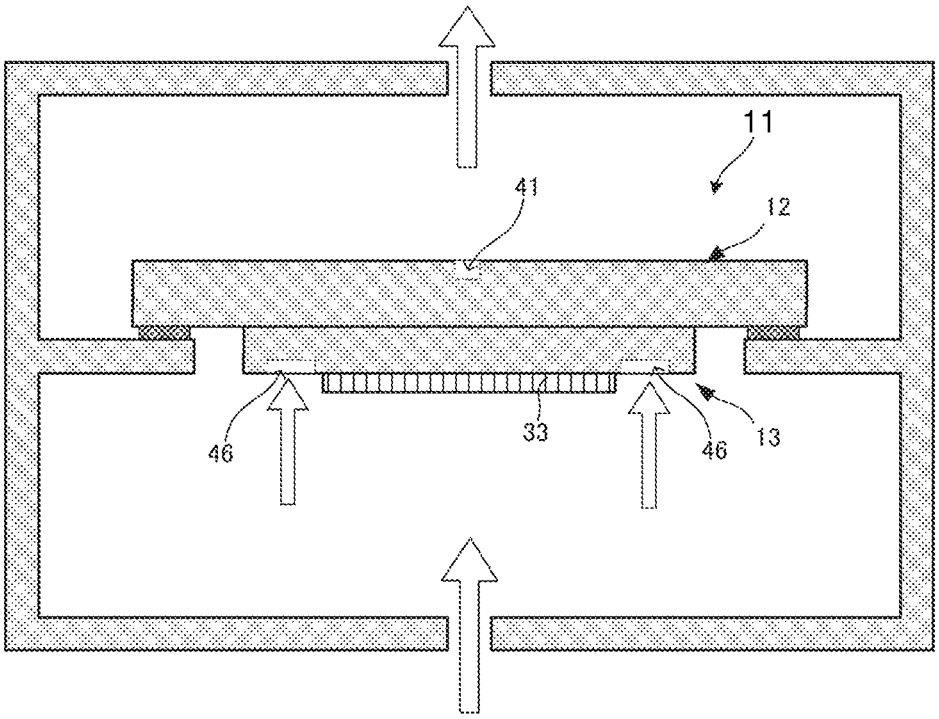
FIG. 9 is a side view illustrating a mounting manner of the fluid control device illustrated in FIG. 1.

FIG. 9 is a side view illustrating a manner in which the fluid control device 11 is mounted in an external structure. In the fluid control device 11, the outside diameter of the valve unit 12 is larger than that of the pump unit 13, and the bottom surface of the pump unit 13 is exposed on the outer peripheral side of the pump unit 13. Accordingly, the fluid control device 11 is joined to an external structure 15 with adhesive 16 by using an area of the bottom surface of the valve unit 12 on the outer peripheral side of the pump unit 13 as a joint surface of the fluid control device 11. Thus, a negative pressure is formed in a space of the external structure 15 on a side where the pump unit 13 is disposed, and a positive pressure is formed in a space where the valve unit 12 is disposed.

Second Embodiment

Next, a fluid control device 51 according to a second embodiment of the present disclosure will be described with reference to FIGS. 10 and 11.

Figure 10:
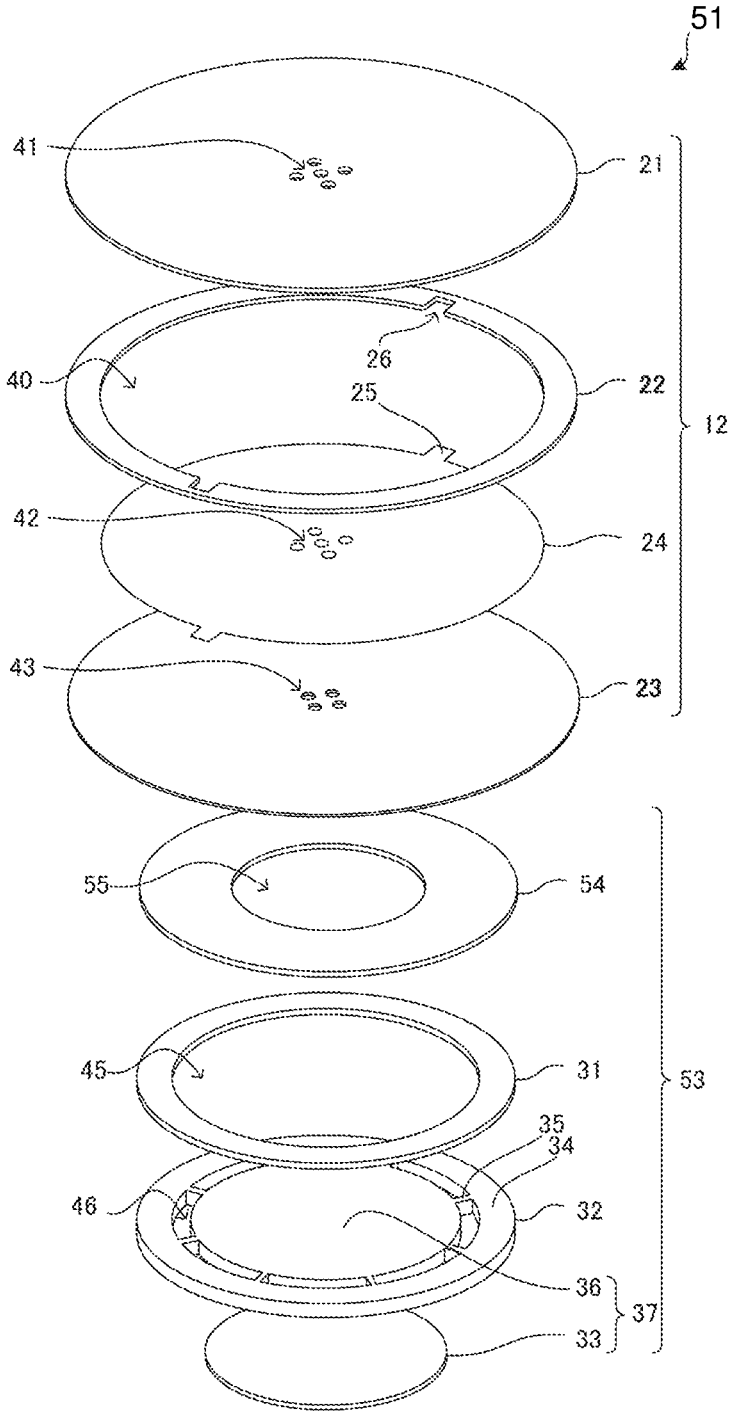
FIG. 10 is an exploded perspective view of a fluid control device according to a second embodiment of the present disclosure, when viewed from a top surface side.
Figure 11:
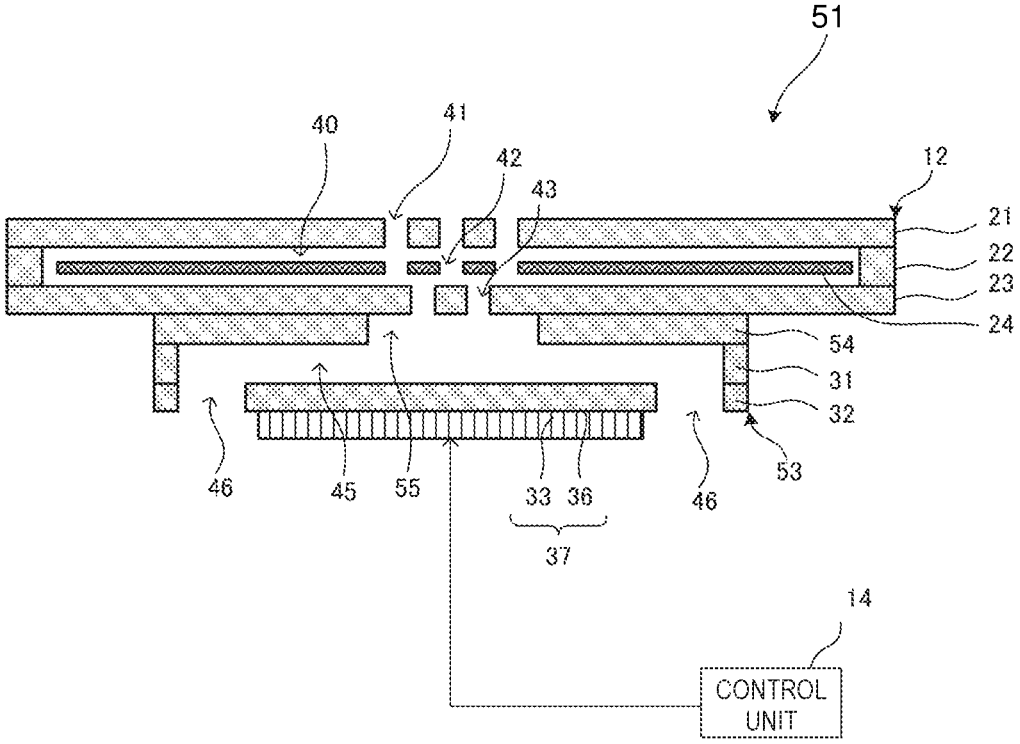
FIG. 11 is a sectional side view of the fluid control device illustrated in FIG. 10.

FIG. 10 is an exploded perspective view of the fluid control device 51 when viewed from the top surface side. FIG. 11 is a sectional side view of the fluid control device 51.

The fluid control device 51 includes a valve unit 12, a pump unit 53, and a control unit 14 (not illustrated). The valve unit 12 and the control unit 14 have the same structures as those of the first embodiment. The pump unit 53 includes a vibration adjustment plate 54, a pump side wall plate 31, a pump bottom plate 32, and a piezoelectric element 33. The pump side wall plate 31, the pump bottom plate 32, and the piezoelectric element 33 have the same structures as those of the first embodiment. On the other hand, in this embodiment, the vibration adjustment plate 54 is provided as a structure different from the structure of the first embodiment.

The vibration adjustment plate 54 is provided to adjust the vibration area of a valve bottom plate 23. Specifically, the vibration adjustment plate 54 is bonded to the valve bottom plate 23 and the pump side wall plate 31 while being disposed therebetween. The vibration adjustment plate 54 is annular when viewed from the top surface side, and has a pump upper chamber 55 provided with a predetermined aperture diameter near the center of the principal surface of the vibration adjustment plate 54 and communicating with a pump chamber 45 provided in the pump side wall plate 31. The aperture diameter of the pump upper chamber 55 is smaller than that of the pump chamber 45. The outside diameters of the vibration adjustment plate 54 and the pump side wall plate 31 are equal to each other.

By attaching the vibration adjustment plate 54 to the valve bottom plate 23, rigidity of the valve bottom plate 23 can be partly increased near the outer peripheral portion. Thus, it is possible to bring about a state in which the valve bottom plate 23 vibrates only near the center portion facing the pump upper chamber 55, but hardly vibrates near the outer peripheral portion. Therefore, the range where the valve bottom plate 23 vibrates can be set according to the aperture diameter of the pump upper chamber 55 in the vibration adjustment plate 54. This allows the vibration area and the structure resonant frequency of the valve bottom plate 23 to be easily adjusted without changing, for example, the thickness and the outside diameter of the valve bottom plate 23. Since vibration near the center portion of the valve bottom plate 23 mainly contributes to fluid vibration and vibration of a film 24, even when the portion of the valve bottom plate 23 near the outer peripheral portion does not vibrate, the effects of improving responsiveness of the valve unit 12 and increasing the discharge flow rate can be obtained sufficiently.

Third Embodiment

Next, a fluid control device 61 according to a third embodiment of the present disclosure will be described with reference to FIG. 12.

Figure 12:
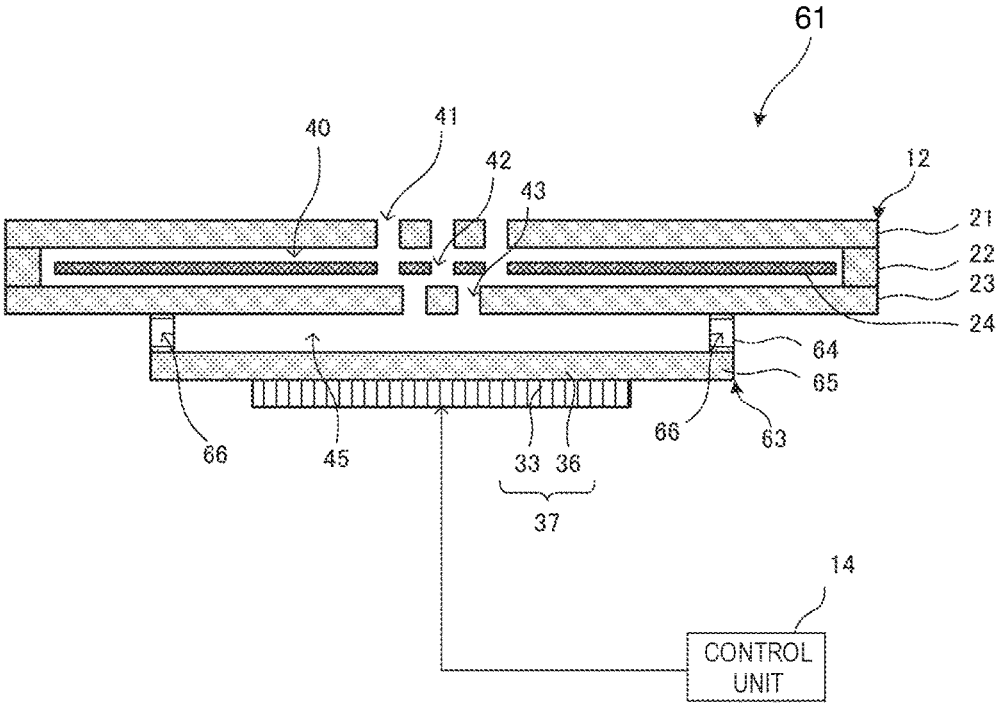
FIG. 12 is a sectional side view of a fluid control device according to a third embodiment of the present disclosure.

FIG. 12 is a sectional side view of the fluid control device 61.

The fluid control device 61 includes a valve unit 12, a pump unit 63, and a control unit 14 (not illustrated). The valve unit 12 and the control unit 14 have the same structures as those of the first embodiment. The pump unit 63 includes a pump side wall plate 64, a pump bottom plate 65, and a piezoelectric element 33. The piezoelectric element 33 has the same structure as that of the first embodiment. On the other hand, in this embodiment, the pump side wall plate 64 and the pump bottom plate 65 are provided as structures different from those of the first embodiment.

The pump side wall plate 64 has a pump chamber 45 and suction holes 66 that allow the pump chamber 45 to communicate with the outside. On the other hand, the pump bottom plate 65 is shaped like a flat plate and does not have a suction hole. Although described in conjunction with the first embodiment, when the pump chamber 45 acoustically resonates, there is little pressure fluctuation in the outer peripheral portion of the pump chamber. Hence, even when the pump side wall plate 64 has the suction holes 66, pressure loss is not increased, and a high flow rate can be obtained. In particular, external fluid linearly flows in the pump chamber 45 through the suction holes 66, and this reduces the flow passage resistance. Hence, compared with the first embodiment, the pressure loss can be further suppressed, and an even higher flow rate can be obtained.

Fourth Embodiment

Next, a fluid control device 71 according to a fourth embodiment of the present disclosure will be described with reference to FIG. 13.

Figure 13:
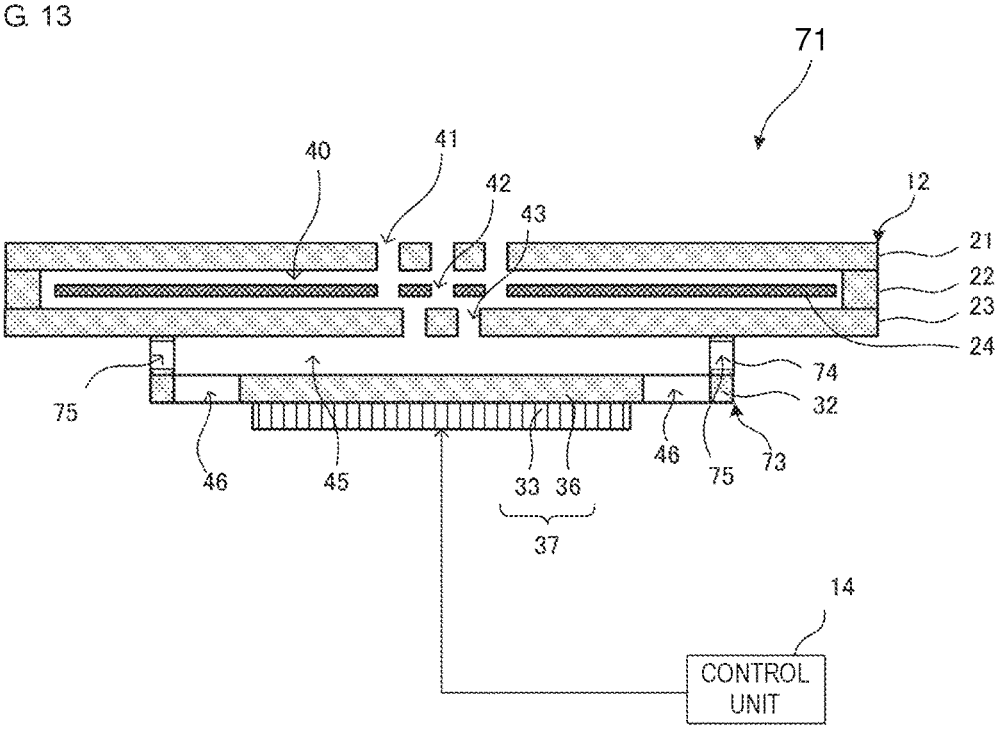
FIG. 13 is a sectional side view of a fluid control device according to a fourth embodiment of the present disclosure.

FIG. 13 is a sectional side view of the fluid control device 71.

The fluid control device 71 includes a valve unit 12, a pump unit 73, and a control unit 14 (not illustrated). The valve unit 12 and the control unit 14 have the same structures as those of the first embodiment. The pump unit 73 includes a pump side wall plate 74, a pump bottom plate 32, and a piezoelectric element 33. The pump bottom plate 32 and the piezoelectric element 33 have the same structures as those of the first embodiment. On the other hand, in this embodiment, the pump side wall plate 74 is provided as a structure different from the structure of the first embodiment.

The pump side wall plate 74 has a pump chamber 45 and suction holes 75 that allow the pump chamber 45 to communicate with the outside. The pump bottom plate 32 also has suction holes 46. In this case, external fluid linearly flows into the pump chamber 45 through the suction holes 75, and spreads all over the aperture area of the suction holes 46 and 75. This can further reduce pressure loss. Therefore, in this embodiment, compared with the first embodiment and the second embodiment, the pressure loss can be further reduced, and an even higher flow rate can be obtained.

Fifth Embodiment

Next, a fluid control device 81 according to a fifth embodiment of the present disclosure will be described with reference to FIG. 14.

Figure 14:
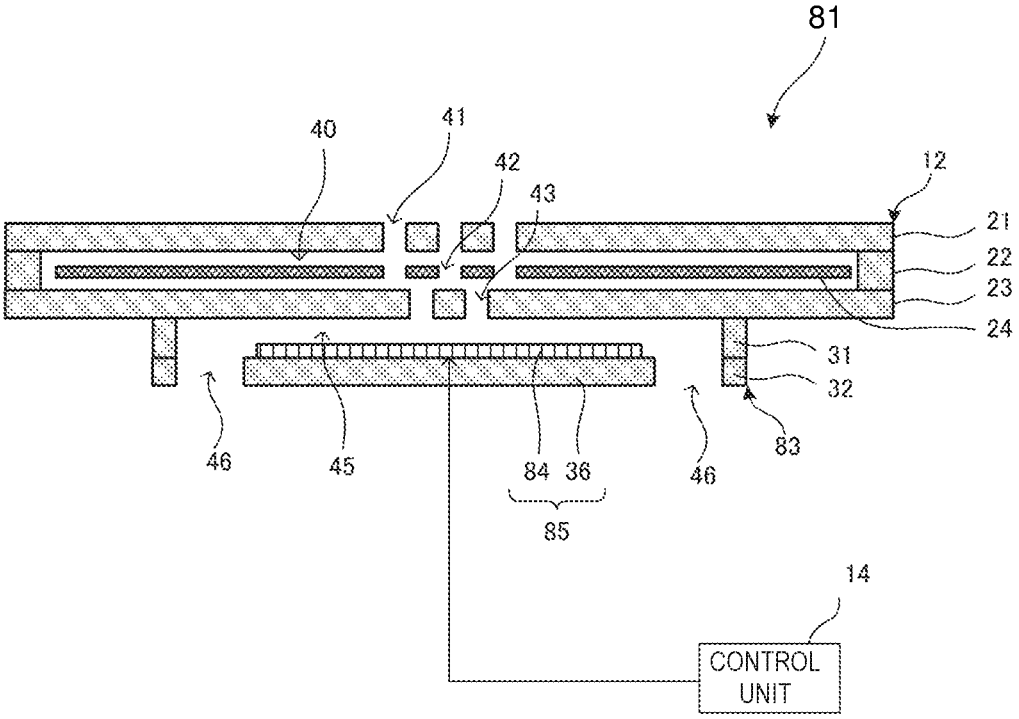
FIG. 14 is a sectional side view of a fluid control device according to a fifth embodiment of the present disclosure.

FIG. 14 is a sectional side view of the fluid control device 81.

The fluid control device 81 includes a valve unit 12, a pump unit 83, and a control unit 14 (not illustrated). The valve unit 12 and the control unit 14 have the same structures as those of the first embodiment. The pump unit 83 includes a pump side wall plate 31, a pump bottom plate 32, and a piezoelectric element 84. The pump side wall plate 31 and the pump bottom plate 32 have the same structures as those of the first embodiment. On the other hand, in this embodiment, the piezoelectric element 84 is provided as a structure different from the structure of the first embodiment.

The piezoelectric element 84 is bonded on a top surface side of a diaphragm 36 in the pump bottom plate 32, and is disposed inside a pump chamber 45. Such arrangement of the piezoelectric element 84 can make the fluid control device 81 thin as a whole, and can prevent the occurrence of breakage of the piezoelectric element 84 due to contact with an external structure.

<<Modifications>>

Figure 15A:
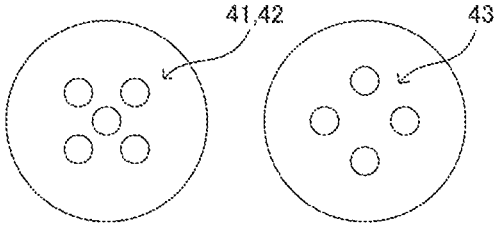
FIGS. 15A to 15E include plan views illustrating modifications of the flow passage holes.
Figure 15B:
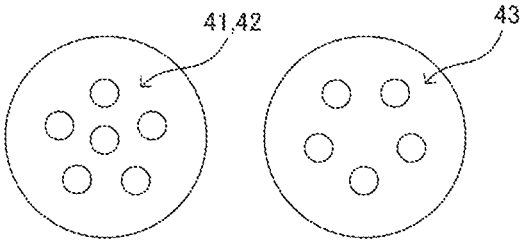
Figure 15C:
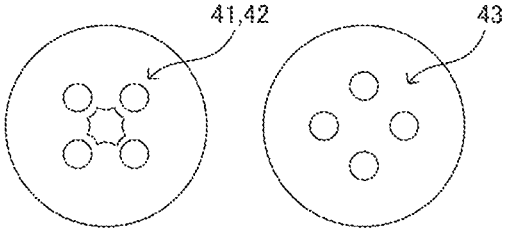
Figure 15D:
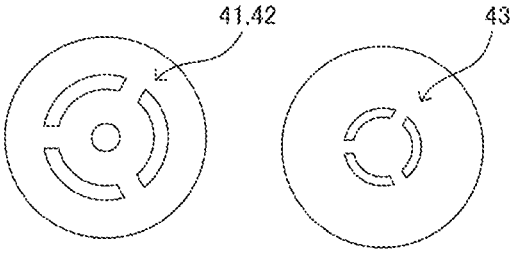
Figure 15E:
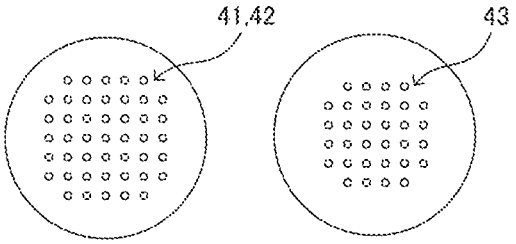

Hereinafter, modifications of shapes of discharge holes 41, film holes 42, communication holes 43, and so on provided in the valve unit 12 will be described. FIGS. 15A to 15E illustrate the planar shape of the discharge holes 41 and the film holes 42 and the planar shape of the communication holes 43 in correspondence to each other. The planar shapes of the flow passage holes illustrated in FIG. 15A are adopted in the above-described embodiments.

The arrangement, number, and shape of the discharge holes 41, the film holes 42, and the communication holes 43 can be set as illustrated in FIGS. 15A to 15E. Even when other arrangement, number, and shape are adopted, they can be appropriately determined as long as the discharge holes 41 and the film holes 42 are not opposed to the communication holes 43.

The present disclosure can be carried out as in the embodiments and modifications described above. However, it should be considered that the above description is illustrative in all respects, but is not restrictive. The scope of the present disclosure is shown not by the above embodiments but by the claims. Further, the scope of the present disclosure is intended to include all modifications within the meaning and scope equivalent to the claims.

11, 51, 61, 71, 81 fluid control device
12 valve unit
21 valve top plate (second plate)
22 valve side wall plate
23 valve bottom plate (first plate)
24 film
25 projection
26 cutout
13, 53, 63, 73, 83 pump unit
31, 64, 74 pump side wall plate
32, 65 pump bottom plate
33, 84 piezoelectric element
34 outer peripheral portion
35 beam portion
36 diaphragm
37 vibration unit
14 control unit
15 external structure
16 adhesive
40 valve chamber
41 discharge hole (second flow passage hole)
42 film hole (third flow passage hole)
43 communication hole (first flow passage hole)
45 pump chamber
46, 66, 75 suction hole
54 vibration adjustment plate
55 pump upper chamber

The invention claimed is:

1. A fluid control device having a flow passage passing through a pump chamber and a valve chamber, comprising:

a first plate and a second plate opposed to the first plate such that the valve chamber is disposed between the first plate and second plate;

a vibration unit comprising a piezoelectric element or a diaphragm and configured to vibrate to cause a fluctuation of an internal pressure in the pump chamber; and a film disposed between the first plate and the second plate, wherein the first plate has a first flow passage hole communicating with the pump chamber at one end and communicating with the valve chamber at another end; and wherein the second plate has a second flow passage hole communicating with the valve chamber, wherein the first flow passage hole and the second flow passage hole are offset along a planar direction of the first plate and second plate, wherein the film has a third flow passage hole offset from the first flow passage hole along the planar direction and aligned with the second flow passage hole along the planar direction, and wherein at least one of the first plate and the second plate is elastically deformed in a direction in which the first plate and the second plate are opposed by transmitting the vibration of the vibration unit to the at least one of the first plate and the second plate.

2. The fluid control device according to claim 1, wherein at least one of the first plate and the second plate vibrates in a manner coupled to the vibration of the vibration unit.

3. The fluid control device according to claim 2, wherein the at least one of the first plate and the second plate has a structure resonant frequency coinciding with a vibration frequency of the vibration unit.

4. The fluid control device according to claim 3, wherein both the first plate and the second plate are vibrated by transmitting the vibration of the vibration unit the first plate and the second plate.

5. The fluid control device according to claim 2, wherein both the first plate and the second plate are vibrated by transmitting the vibration of the vibration unit the first plate and the second plate.

6. The fluid control device according to claim 2, wherein a phase of a fluctuation of a distance between the first plate and the second plate has a phase difference from a phase of the vibration of the vibration unit.

7. The fluid control device according to claim 1, wherein at least one of the first plate and the second plate is vibrated by transmitting the vibration of the vibration unit to the at least one of the first plate and the second plate via a fluid.

8. The fluid control device according to claim 7, wherein the at least one of the first plate and the second plate has a structure resonant frequency coinciding with a vibration frequency of the vibration unit.

9. The fluid control device according to claim 7, wherein both the first plate and the second plate are vibrated by transmitting the vibration of the vibration unit the first plate and the second plate.

10. The fluid control device according to claim 7, wherein a phase of a fluctuation of a distance between the first plate and the second plate has a phase difference from a phase of the vibration of the vibration unit.

11. The fluid control device according to claim 1, wherein both the first plate and the second plate are vibrated by transmitting the vibration of the vibration unit the first plate and the second plate.

12. The fluid control device according to claim 1, wherein a phase of a fluctuation of a distance between the first plate and the second plate has a phase difference from a phase of the vibration of the vibration unit.

13. The fluid control device according to claim 12, wherein the phase of the fluctuation of the distance between the first plate and the second plate coincides with a phase of a fluctuation of a flow rate in the first flow passage hole, or is closer to the phase of the vibration of the vibration unit than the phase of the fluctuation of the flow rate in the first flow passage hole.

14. The fluid control device according to claim 1, wherein the vibration unit includes the diaphragm and the piezoelectric element, the diaphragm facing the pump chamber and the piezoelectric element fixed to the diaphragm.

15. The fluid control device according to claim 1, wherein the first plate and second plate are on one side of the pump chamber, and the vibration unit is on another side of the pump chamber opposite to the one side.

16. A fluid control device having a flow passage passing through a pump chamber and a valve chamber, comprising:

a first plate and a second plate opposed to the first plate such that the valve chamber is disposed between the first plate and second plate;

a vibration unit comprising a piezoelectric element or a diaphragm and configured to vibrate to cause a fluctuation of an internal pressure in the pump chamber; and a film disposed between the first plate and the second plate, wherein the first plate has a first flow passage hole communicating with the pump chamber at one end and communicating with the valve chamber at another end; and wherein the second plate has a second flow passage hole communicating with the valve chamber, wherein the first flow passage hole and the second flow passage hole are offset along a planar direction of the first plate and second plate, wherein the film has a third flow passage hole offset from the first flow passage hole along the planar direction and aligned with the second flow passage hole along the planar direction, wherein at least one of the first plate and the second plate is elastically deformed in a direction in which the first plate and the second plate are opposed by transmitting the vibration of the vibration unit to the at least one of the first plate and the second plate, and wherein a distance between the first plate and the vibration unit decreases simultaneously when the elastic deformation is caused in a direction to increase a distance between the first plate and the second plate, and increases simultaneously when the elastic deformation is caused in a direction to decrease the distance between the first plate and the second plate.

* * * * *